US005109323A

United States Patent [19]

Waycaster

[11] Patent Number: 5,109,323

[45] Date of Patent: Apr. 28, 1992

[54] SHOCK RESISTANT LIGHTING FIXTURE

[75] Inventor: Brad Waycaster, Tupelo, Miss.

[73] Assignees: Thomas Industries, Inc.; Day-Brite Lighting, Inc., both of Tupelo, Miss.

[21] Appl. No.: 616,614

[22] Filed: Nov. 21, 1990

[51] Int. Cl.[5] ..... F21S 3/02

[52] U.S. Cl. ..... 362/217; 362/226; 362/260

[58] Field of Search ..... 439/612, 817, 824, 237, 439/226, 242, 244; 362/217, 226, 260, 296

[56] References Cited

U.S. PATENT DOCUMENTS

| | | | |
|---|---|---|---|
| 2,567,726 | 9/1951 | Pistey | 362/217 |
| 2,722,666 | 11/1955 | Hodgkins | 439/294 |
| 2,769,897 | 11/1956 | Rzeszutko | 362/217 |
| 3,097,903 | 7/1963 | Moore | 439/237 |
| 3,426,312 | 2/1969 | Gerald | 339/56 |
| 3,685,003 | 8/1972 | Watt | 339/56 R |
| 3,832,540 | 8/1974 | Roth | 362/217 |
| 3,909,100 | 9/1975 | Hodge, Jr. | 339/52 S |
| 3,911,265 | 10/1975 | Landrum et al. | 362/296 |
| 4,070,570 | 1/1978 | Wetmore et al. | 362/218 |
| 4,198,108 | 4/1980 | Bassetto | 362/260 |
| 4,288,846 | 9/1981 | Fletcher et al. | 362/217 |
| 4,322,783 | 3/1982 | Chappell et al. | 362/217 |
| 4,323,953 | 4/1982 | Hutchison | 362/226 |
| 4,422,712 | 12/1983 | Koszytorz | 339/255 R |
| 4,498,126 | 2/1985 | Hernandez | 362/220 |
| 4,533,851 | 8/1985 | Block et al. | 313/51 |
| 4,536,832 | 8/1985 | Lemons | 362/264 |
| 4,542,947 | 9/1985 | Flor et al. | 439/242 |
| 4,597,035 | 6/1986 | Lettenmeyer | 362/219 |
| 4,722,039 | 1/1988 | Gaugel | 362/296 |
| 4,744,767 | 5/1988 | Henrici et al. | 439/226 |
| 4,803,600 | 2/1989 | Pepping | 362/217 |
| 4,842,535 | 6/1989 | Velke, Sr. et al. | 439/232 |
| 5,006,970 | 4/1991 | Mackrewicz | 362/260 |

*Primary Examiner*—Ira S. Lazarus
*Assistant Examiner*—Sue Hagarman
*Attorney, Agent, or Firm*—Hill, Van Santen, Steadman & Simpson

[57] ABSTRACT

A socket arrangement for a light fixture holding a tubular lamp having contacts on opposite ends, providing a fixed socket opposite a spring loaded socket with a lamp maneuvering cavity adjacent to the fixed socket, allowing a tubular lamp to be installed nearly straight-in to the sockets, and preventing electrical shock. By providing the maneuvering cavity opposite the spring loaded socket, a first end of a tubular lamp can be maneuvered into the cavity to allow an opposite end of the tubular lamp to insert into the spring loaded contact, and further insertion causes compression of the spring loaded contact, which retracts the first end out of the maneuvering cavity a sufficient distance to swing the first end through a slot formed in a side of the fixed socket and into the fixed socket, whereupon the spring loaded socket expands to resiliently hold the tubular lamp between the two sockets. Handling exposure of a free end of a tubular lamp while an opposite end is making electrical contact with a terminal is thus minimized during relamping.

13 Claims, 2 Drawing Sheets 10
11
12
14
16
18
19
20
20a
30
30a
36
36a
40
42
44
46
48
50
52
60
60a
62
62a
64
II
III
VI

SHOCK RESISTANT LIGHTING FIXTURE

BACKGROUND OF THE INVENTION

The invention pertains to a shock resistant lighting fixture and in particular an electric shock resistant tungsten halogen fixture. The present invention provides a novel means of relamping a lighting fixture with a tubular lighting element.

U.S. Pat. No. 4,498,126 discloses a lighting fixture with a relamping socket apparatus. A hinged bracket is provided for permitting the swinging away of at least one socket to permit easy access to an elongated double ended bulb for relamping purposes. Sockets are each spring loaded and partly biased against the bulb in the open relamp position and firmly biased against the bulb in the position of use.

Other references show sockets being movable from one position to another for insertion of a lamp or in which portion of the fixture is movable to provide easy insertion as shown in U.S. Pat. Nos. 4,744,767; 3,909,100; and 4,323,953.

Various configurations of spring loaded sockets are disclosed in U.S. Pat. Nos. 4,842,535; 4,597,035; 4,422,712; 3,685,003; 3,426,312; and 4,070,570.

Lamp holders with permanently positioned sockets for tungsten halogen lamps are disclosed in U.S. Pat Nos. 4,322,783; 4,536,832; and 4,288,846. These structures are typical of the prior art structures in which the ends of the tungsten halogen lamp are securely attached to terminals of the sockets.

The present invention combines in a housing at least one spring loaded socket for receiving a first end of a tube lighting element and a cavity disposed in the housing nearto a second socket for receiving a second end of the tubular lighting element such that the tubular lighting element can be first inserted at the second end into the cavity, positioned at its first end into the first tube socket, compressing the first tube socket with the first end by proceeding the tube lighting element out of the cavity, and then swinging the second end of the tube element into the second socket, whereupon the spring loaded first socket exerts axial force on the tube element to compress the tube element into the second socket. Such an arrangement is advantageous to maneuver the tubular lighting element into the respective sockets.

The prior art cited above discloses the use of spring loaded sockets for use with lamps, such as tungsten halogen lamps, as used in the submitted invention. However, none of the references discloses the features of the cavity located in the casting of the fixture nearto a fixed socket and opposite a spring loaded socket, such that the lamp can be inserted into the cavity at one end and then into the spring loaded socket at another end and, after compressing the spring, can be removed from the cavity and placed into the fixed socket.

SUMMARY OF THE INVENTION

The present invention relates to lighting fixtures which hold a tubular lighting element or tubular lamp having contact elements on opposite ends. Such a fixture includes a tungsten halogen lamp fixture.

Underwriters Laboratory has proposed a new requirement on tungsten halogen light fixtures stating that upon relamping, power to the fixtures shall be cut off by an interlock switch, or the fixture be provided with mechanical barriers preventing the lamp installer from placing the lamp on one of the socket contacts and touching the other end of the lamp. This inventive fixture makes it very difficult for the installer to touch one lamp end when the respective other lamp end is touching a socket contact.

By increasing the length of the lamp sockets, the lamp ends cannot touch the socket contacts unless the lamp is inserted almost straight in. However, typical reflector design is such that it interferes with the lamp prohibiting the lamp from being inserted straight in. Therefore, to install a lamp according to the present invention, a hole or cavity is located in the reflector beside one of the lamp sockets. Inserting one end of the lamp into that cavity and swinging the lamp so it is aligned and parallel to the two sockets allows the lamp end opposite the reflector cavity to be placed in the slot of the socket opposite the cavity. The socket opposite the cavity is spring loaded. The lamp can then be pushed into the spring loaded socket, far enough to swing a trailing lamp end into the socket which is beside the cavity.

The invention so described provides a safe arrangement for quickly installing a lamp into a lamp fixture without requiring the lamp be depowered, or cut off by an interlock switch.

DETAILED DESCRIPTION OF THE PREFERRED EMBODIMENTS

Figures 1, 2, 3, 6:
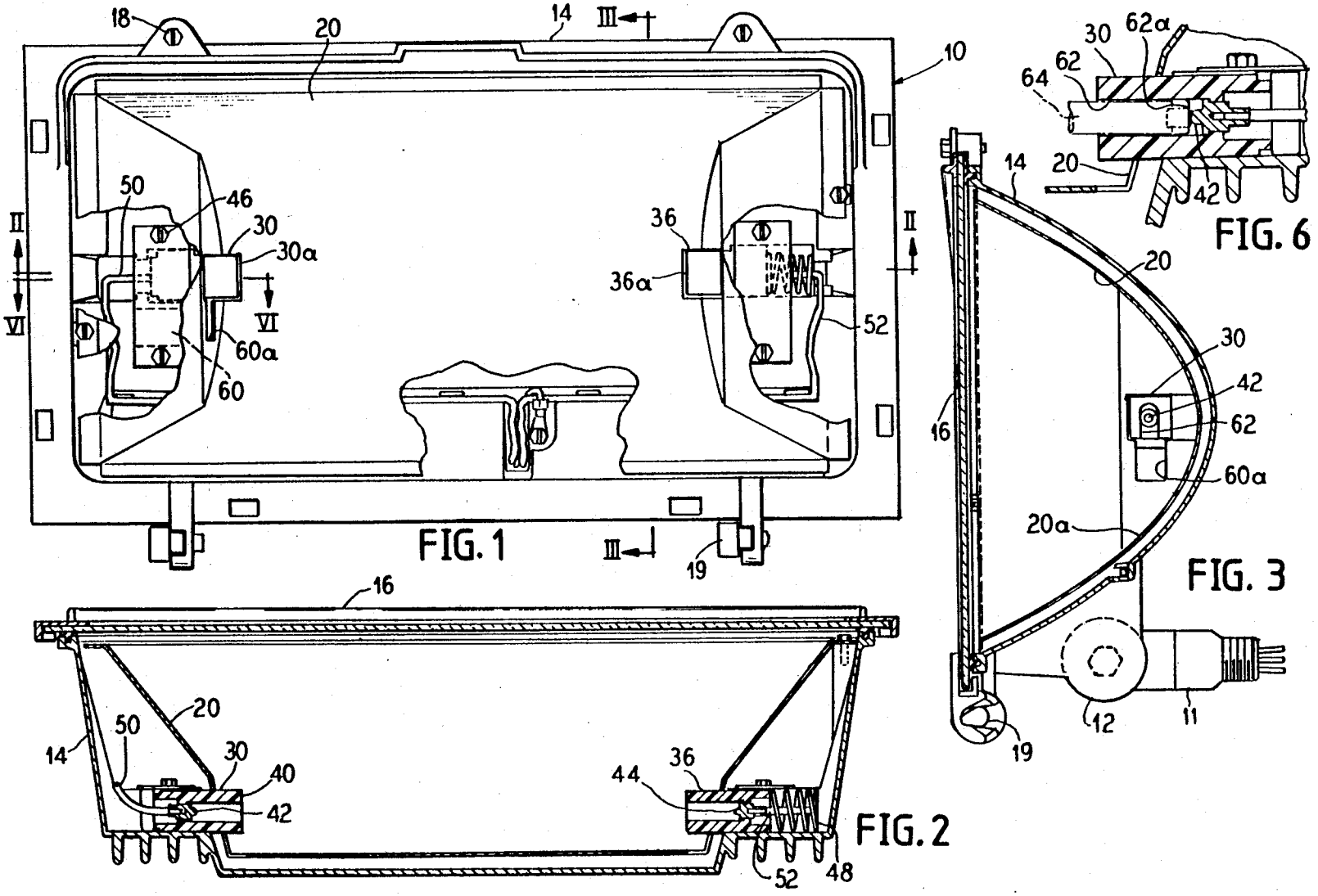
FIG. 1 is a front elevation view of a lighting fixture with portions of a reflector removed for clarity.
FIG. 2 is a sectional view generally along line II—II of FIG. 1.
FIG. 3 is a sectional view taken generally along III—III of FIG. 1.
FIG. 6 is an enlarged sectional view taken generally along line VI—VI of FIG. 1.

FIG. 1 shows a light fixture generally at 10 having a housing 14 covered on a front side with a lens 16 (shown more clearly in FIGS. 2–3). Inside the housing is mounted a reflector 20 which is shaped to reflect light outwardly through the lens 16. The housing 14 also holds a fixed socket 30 and a spring loaded socket 36 both of which protrude through the reflector 20. The fixed socket 30 has mounted therein a first contact 42 and the spring loaded socket 36 has mounted therein a second contact 44. The first contact 42 is connected to a wire 50 and the second contact 44 is connected to a wire 52, the wires 50, 52 carry power for the fixture 10.

The lens 16 is attached via screws 18 to one side of the housing 14 and are pivotally connected using hinges 19 at an opposite side thereof. Thus the lens 16 provides a door openable to replace a lamp (not shown) into the sockets 30, 36.

The housing 14 is mounted to a structure (not shown) in a pivoting fashion at a joint 12 for aiming the light beam in a particular direction. A conduit 11 provides an entryway into the housing for electrical wires.

As shown in FIG. 2 the spring loaded socket 36 is biased in an outward direction by a coiled spring 48 arranged between the spring loaded socket 36 and the housing 14. The wire 52 connected to the contact 44 is arranged inside the coils of the coiled spring 48.

The fixed socket 30 and the spring loaded socket 36 are mounted to the housing 14 with screws 46.

As shown in FIG. 3, the fixed socket 30 comprises a slot 62 arranged laterally through the fixed socket 30 allowing entry of a lamp (shown in FIGS. 4A–4D) through the slot 62. A second slot 63 is arranged laterally through the spring loaded contact 36, the second slot 63 opening toward the same directional orientation as the first slot 62. A cavity 60 is formed by a hole 60*a* in the reflector 20 and the space between the housing 14 and the reflector 20. The cavity 60 is located nearto the fixed socket 30.

It should be noted that the slot 62, 63 are oriented downward as shown in FIG. 1. By orienting the slots this way, lamp elements cannot be inserted into either socket 30, 36 unless one end is inserted into the cavity 60, as described hereinafter. If the slots were oriented forwardly in FIG. 1, it would be possible to insert one end of the lamp element into a socket, with a free end of the lamp element projecting angularly forwardly of the reflector. Thus, the hazard of maintenance personnel contact with the free end would be present. By orienting the slots downwardly toward a surface 20*a* of the reflector 20, interference with this surface 20*a* prevents sufficient clearance to insert one end of the lamp element into one of the sockets 30, 36 unless the cavity 60 utilized. Thus, restrictive shaping and sizing of the reflector and protruding ends 30*a*, 36*a* of the sockets 30, 36 provides purposeful insufficient clearance to incorrectly install a lamp element unless the cavity 60 is used. In other words, the lamp element is just too long to maneuver into the two sockets 30, 36 unless a first end is first inserted into the cavity 60, and the lamp is thereafter installed nearly "straight-in".

Figure 4A:
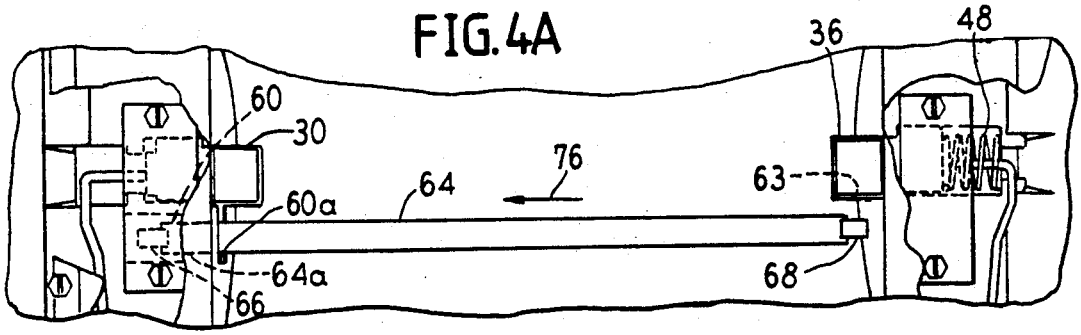
FIGS. 4A–4D are partial elevational views of a socket arrangement of the fixture of FIG. 1 showing various procedural stages of installing a lamp into the socket arrangement with portions of the reflector removed for clarity.
Figure 4B:
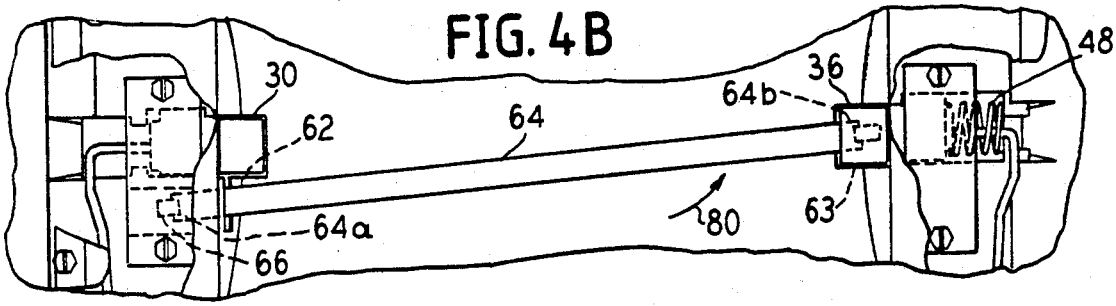

The inventive attributes of the Applicant's fixture are demonstrated in FIGS. 4A–4D. FIG. 4A shows a tubular lamp or tubular lighting element 64 having a first end contact 66 and a second end contact 68 for electrically charging the lamp 64. The lamp 64 is first maneuvered such that an end portion 64*a*, adjacent the first contact 66, is inserted into the cavity 60. This maneuvering direction is indicated generally by the arrow 76. As shown in FIG. 4B the lamp 64 can then be pivoted upward in the figure, according to the direction of arrow 80, such that a second end portion 64*b* adjacent to the second contact 68, can be passed through the second slot 63 and into the spring loaded socket 36.

Figure 4C:
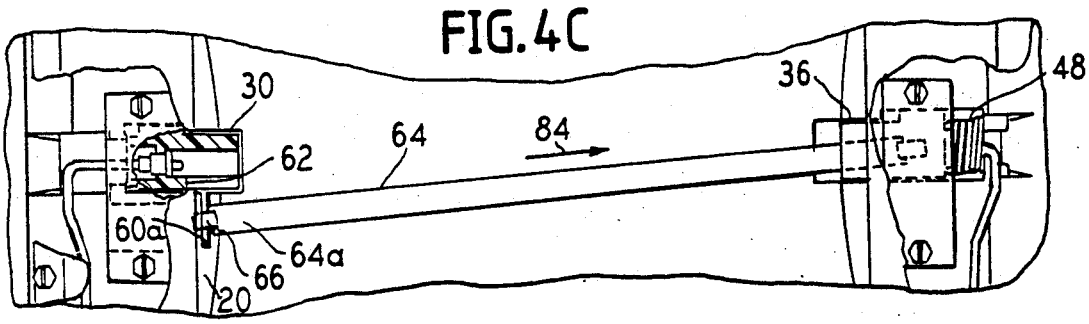
Figure 4D:
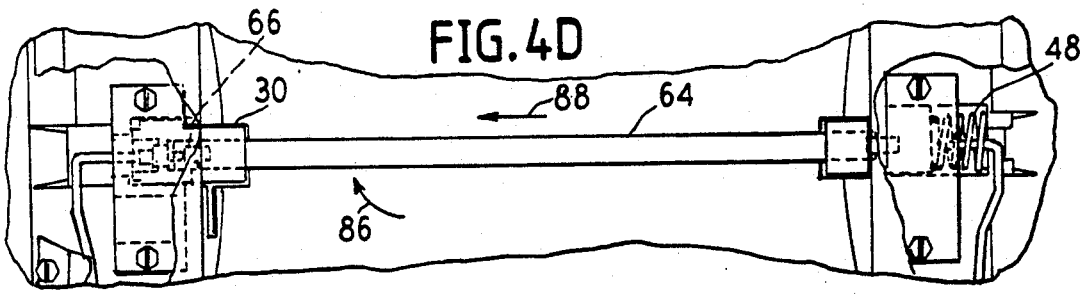

As shown in FIG. 4C, the lamp 64 can be pushed in the direction of arrow 84 toward the second contact 44, and once abutting, the lamp 64 can push the spring loaded contact in a direction away from the fixed socket 30, compressing the coiled spring 48. When such movement according to the arrow 84 proceeds to a sufficient point, as shown in FIG. 4C, the end portion 64*a* of the lamp 64 adjacent to the first end contact 66 can be swung through the first slot 62 and into the fixed socket 30 as shown in FIG. 4D. This movement is indicated by an arrow 86. In this position, the coiled spring 48 is free to expand and thrust the lamp 64 in a direction of an arrow 88 into the fixed socket 30, whereupon the first end contact 66 makes electrical contact with the first contact element 42.

Thus, it can be seen that the installation of the lamp 64 proceeds nearly straight-in with a minimum amount of exposure of the first end contact 66 outside of the cavity 60 or the fixed socket 30. As shown in FIG's 4C, 4D the first end contact 66 barely protrudes or reappears out of the cavity 60 before it is swung into the fixed socket 30. The hole 60*a* and the cavity 60 are laterally open to the slot 62. It can be readily designed that the first end contact 66 is always behind the reflector 20 when the lamp 64 swings into position as shown by arrow 86 in FIG. 4D. Thus the possibility of personal contact with the first end contact 66, while the second end contact 68 is touching the second contact element 44, is minimized.

Figure 5:
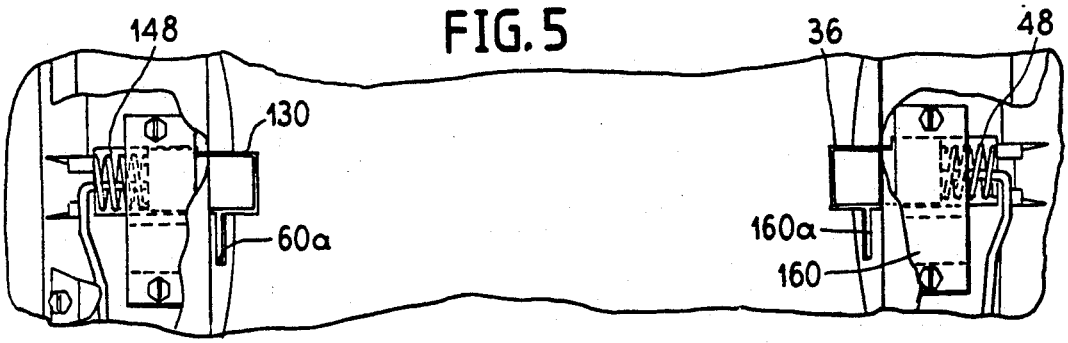
FIG. 5 is a partial elevational view of the fixture of FIG. 1 utilizing an alternate embodiment of the socket arrangement shown therein.

FIG. 5 shows an alternate embodiment of the invention wherein it can be readily visualized that the fixed socket 30 can be replaced with a second spring loaded socket 130 biased by a second coiled spring 148 in an identical configuration as the spring loaded socket 36. Also, a second cavity 160, with a second hole 160*a*, can be utilized adjacent to the spring loaded socket 36. This embodiment provides symmetry and maximum flexibility of installation of the lamp 64 (not shown in FIG. 5) as the lamp can be inserted into either cavity 60 or the second cavity 160 and the lamp can compress either spring loaded socket 130, 36 for installation of the lamp. When the lamp is installed, the lamp 64 would be resiliently held between both spring loaded sockets 36, 130.

FIG. 6 shown in detail the slot 62 terminating at a slot wall 62*a*. It is to be noted that the slot wall 62*a* is located behind the reflector 20, between the reflector 20 and the housing 14, so that the first contact 66 of the lamp 64 (shown dashed) can be swung from the cavity 60, through the slot 62 and into the fixed socket 30 without the first contact 66 being significantly exposed to a maintenance person relamping the fixture.

Although the present invention has been described with reference to a specific embodiment, those of skill in the art will recognize that changes may be made thereto without departing from the scope and spirit of the invention as set forth in the appended claims.

I claim as my invention:

1. A socket arrangement for a light fixture for holding a tubular lamp having end contacts at opposite ends, wherein said socket arrangement is mounted to a housing of said fixture, comprising:

a first socket, mounted to an inside surface of said housing and having a first contact element terminal therein for mating with a first end contact of the lamp;

a second socket, having a second contact element therein for mating with a second end contact of the lamp, said first socket oriented facing said second socket, said second socket resiliently mounted to the inside surface of said housing movable toward and away from said first socket; and said housing provides a cavity adjacent to said first socket for receiving a first end of the lamp therein to position a second end of the lamp into said second socket, said second socket resiliently displaceable a distance sufficient to retract said first end of said lamp in a direction outward from said cavity, inwardly of the housing, to a position of alignment to insert said first end into said first socket, said resilient displaceability being aligned with an axis interconnecting said sockets.

2. A socket arrangement according to claim 1, wherein said fixture further comprises a reflector surface mounted to the inside surface of said housing and extending adjacent to and all-around said sockets, and said cavity is formed by a hole in said reflector surface and a corresponding space between said reflector surface and said housing, and said second socket protrudes inwardly from said housing to such an extent that a clear distance between said second socket and said reflector prohibits sufficient entry of said second end of said lamp into said second socket to make electrical contact between said second end contact and said second contact element unless said first end of said lamp is first inserted into said cavity.

3. A socket arrangement according to claim 1, wherein said first socket and said second socket provide laterally arranged slots progressing axially along the sockets from inwardly leading ends of said sockets to permit lateral entry of said first end and said second end of said lamp into said first socket and said second socket respectively.

4. A socket arrangement according to claim 1, wherein said first socket is resiliently mounted to said housing and movable toward and away from said second socket; and said housing further provides a second cavity adjacent to said second socket, for receiving the second end of the lamp therein to position the first end of the lamp into said first socket, said first socket resiliently displaceable a distance sufficient to retract said second end of said lamp outward from said second cavity, inwardly of the housing, to a position of alignment to insert said second end into said second socket.

5. A light fixture for holding a tubular lamp having end contacts at each opposite end comprising:

a housing providing a concave inside surface;

a first socket, mounted to said inside surface of said housing and having a first contact element recessed therein for mating with a first end contact of the lamp;

a second socket, having a second contact element recessed therein for mating with a second end contact of the lamp, said first socket oriented axially aligned with said second socket, said second socket resiliently mounted to said inside surface of said housing, movable toward and away from said first socket; and a reflector mounted covering said inside surface of said housing, said first socket and said second socket protruding from said inside surface of said housing through said reflector, said reflector providing a hole adjacent to said first socket for receiving a first end of the lamp therein, during relamping, to position a second end of the lamp into said second socket, said second socket resiliently displaceable a distance sufficient to retract said lamp in a direction from said hole inwardly of the housing, to position said first end of said lamp in alignment to insert said first end into said first socket, wherein said first socket and said second socket provide laterally arranged slots proceeding axially along said sockets from inwardly leading ends of said sockets, to permit lateral entry of said first end and said second end of said lamp into said first socket and said second socket respectively.

6. A light fixture according to claim 5, wherein said hole is open to the laterally arranged slot of the first socket.

7. A light fixture according to claim 5, wherein said first socket is resiliently mounted to said housing and movable toward and away from said second socket; and said reflector further provides a second hole adjacent to said second socket, for receiving the second end of the lamp therein to position the first end of the lamp into said first socket, said first socket resiliently displaceable a distance sufficient to retract said second end of said lamp in a direction from said second hole inwardly of the housing, to a position of alignment to insert into said second socket.

8. A light fixture according to claim 5, wherein said second socket protrudes inwardly of the reflector to such an extent that a clear distance between said second socket and said reflector prohibits sufficient entry of said second end of said lamp into said second socket to make electrical contact between said second end contact and said second contact element, unless said first end of said lamp is first inserted into said hole.

9. A light fixture according to claim 5, wherein said laterally arrange slots are oriented open toward a surface of said reflector.

10. A method for relamping a light fixture for holding a tubular lamp therein, the tubular lamp having end contacts at each opposite end, comprising:

provide a light fixture having a housing with a first socket and a second socket mounted facing each other at opposite ends of the housing in axial alignment;

provide a reflector mounted to said housing on an inside surface of said housing, with said sockets protruding from said housing through said reflector;

provide a hole in said reflector adjacent to said first socket;

provide that said second socket is spring loaded, resiliently movable axially toward and away from said first socket;

provide that the first socket and the second socket have contact elements arranged recessed inside each socket;

provide a lamp element having end contacts at each opposite end;

insert the lamp element at a first end into the hole adjacent to said first socket;

swing a second end of the lamp element toward the second socket and insert therein;

push the lamp element toward the second socket, making electrical contact between the respective end contact of the lamp and the contact element of the second socket, and further push the lamp to depress the spring loaded second socket;

swing the first end of the lamp element into alignment with the first socket and insert therein; and allow the spring loaded second socket to retract, thus holding the lamp element resiliently between the first socket and the second socket.

11. A method according to claim 10 comprising the further steps of:

provide that the first socket and the second socket comprise axially arranged slots having identical lateral open direction orientation, the slots beginning at inward ends of the sockets and terminating at points between the reflector and the housing;

and when the second end of the lamp element is swung and inserted into the second socket the lamp element passes through the respective slot of the second socket;

and when the first end of the lamp element is aligned and inserted into the first socket the first end of the lamp element passes through the slot of the first socket.

12. A method according to claim 11 comprising the additional steps of:

provide a second hole in the reflector adjacent to the second socket;

provide that the first socket is also spring loaded with respect to the housing, resiliently movable toward and away from said second socket; and installation of the lamp element may proceed by inserting either end of the lamp element into either the hole adjacent to the first socket or the second hole adjacent to the second socket with the resultant free end of the lamp element thereafter inserted into the respective other of the first socket or the second socket, and thereafter the end of the lamp element which was inserted into the hole or the second hole is inserted into the respective socket adjacent thereto.

13. A method according to claim 11, wherein said axially arranged slots are oriented open toward a surface of the reflector.

* * * * *